US005449303A

United States Patent [19]

McLeod

[11] Patent Number: 5,449,303

[45] Date of Patent: Sep. 12, 1995

[54] EXTENDABLE HANDLE, CLEANING DEVICE AND CLEANING HEADS

[76] Inventor: David W. McLeod, 645 Dunmar Cir., Winter Springs, Fla. 32708

[21] Appl. No.: 164,214

[22] Filed: Dec. 9, 1993

[51] Int. Cl.[6] ..... B05B 13/04; B05B 15/06

[52] U.S. Cl. ..... 239/754; 239/273; 280/655.1; 280/47.315

[58] Field of Search ..... 239/273, 754; 280/47.18, 655, 655.1, 47.315, 47.371

[56] References Cited

U.S. PATENT DOCUMENTS

| | | | |
|---|---|---|---|
| 1,582,045 | 4/1926 | DonHowe | 280/47.371 X |
| 2,519,113 | 8/1950 | Cohn | 280/47.315 X |
| 2,938,734 | 5/1960 | Guimond | 280/47.315 X |
| 3,508,709 | 4/1970 | Small et al. | 239/754 |
| 3,913,837 | 10/1975 | Grant | 239/754 X |
| 4,011,994 | 3/1977 | Lenz | 239/754 |
| 4,200,236 | 4/1980 | Briar | 239/754 X |
| 4,903,364 | 2/1990 | Long | 239/754 X |
| 5,088,232 | 2/1992 | Aurness et al. | 239/754 X |

*Primary Examiner*—William Grant
*Attorney, Agent, or Firm*—James H. Beusse

[57] ABSTRACT

A cleaning device for delivering a fluid under pressure onto a surface includes a head movable on the surface for spraying the fluid and an extendable handle for controlling placement of the head. The extendable handle has a pair of sets of members arranged in telescoping relation for movement between at-rest and extended positions. One of the members is defined by a pair of sets of articulated parts with one of the articulated parts extending exteriorly of the other of the members when the member sets are in the extended position thereof. A set of resiliently urged detents releasably retain the member sets against displacement from the at-rest position thereof, and a set of pawls are operable in response to pivotal movement of the one articulated part for interlocking the other of the articulated parts and the other of the member when the member sets are in their extended positions thereof.

11 Claims, 6 Drawing Sheets

EXTENDABLE HANDLE, CLEANING DEVICE AND CLEANING HEADS

FIELD OF THE INVENTION

This invention relates in general to cleaning devices, an extendable handle and cleaning heads therefor and in particular to such cleaning devices which spray a fluid under pressure onto a surface to dislodge foreign particles therefrom.

BACKGROUND OF THE INVENTION

In the past, various different cleaning devices have been utilized for spraying fluid under pressure onto a surface to clean the surface by dislodging various undesirable foreign particles therefrom. One of the aforementioned past cleaning devices was merely a wand having at least one nozzle for spraying fluid under pressure onto the surface. One of the disadvantageous or undesirable features of such past wand is believed to be that the sprayed fluid splashed from the surface in an uncontrollable manner which may have undesirably wetted adjacent structures, objects or surfaces.

Another of the past cleaning devices had a rotary lawn mower type housing supported on a set of wheels, and spraying nozzles were provided beneath such housing. One of the undesirable or disadvantageous features of the above discussed past cleaning device having a rotary lawn mower type housing is believed to be that such past cleaning devices may not have had a profile low enough to have been operable in confined spaces, such as for instance beneath shelving or other structures spaced adjacent the surface to be cleaned. Further, it is also believed that the cleaning device having a rotary lawn mower type housing may also have caused splashing of the sprayed fluid from the surface in an uncontrolled pattern, as previously discussed.

Still another of the past cleaning devices was of the hovercraft type which had a housing floatably movable on the surface in response to the fluid under pressure sprayed under pressure onto the surface through nozzles contained beneath such housing. One of the undesirable features of the hovercraft type cleaning devices is believed to be that the movement of such cleaning devices on the surface to be cleaned may have been difficult to control by the operator of such cleaning device due to the above discussed floating movement thereof. It is also believed that the profile of the hovercraft type cleaning device may not have been low enough with respect to the surface to be cleaned so as to have been operable in confined spaces, such as beneath shelving or the like spaced adjacent the surface, as previously discussed.

SUMMARY OF THE INVENTION

In one form of the invention, an extendable handle is provided with a pair of sets of handle means arranged at least in part in telescoping relation for relative movement between at-rest and extended positions. One of the handle means of the handle means sets comprises a pair of sets of articulated means arranged for relative pivotal movement, and one of the articulated means of the articulated means sets extend exteriorly of the other of the handle means of the handle means sets when said handle means sets are in the extended positions thereof, respectively. A set of means are associated with the other handle means for releasable engagement with the one handle means to releasably retain the handle means sets against displacement from the at-rest positions thereof, and a set of means associated with the other of the articulated means of the articulated means sets are operable generally in response to the relative pivotal movement of the one articulated means for interlocking the other articulated means and the other handle means in the extended positions thereof, respectively.

A cleaning device is provided in one form of the invention for delivering a fluid under pressure from a source thereof onto a surface having foreign particles thereon. The cleaning device has head means for communication with the source, and the head means is movably seated on the surface for spraying the fluid under pressure onto the surface to dislodge therefrom at least some of the foreign particles. A pair of sets of handle means arranged in part in telescoping relation are operable generally for extension from at-rest positions into extended positions with the handle means of the handle means sets being arranged in articulated relation in the extended positions thereof, respectively. Means is provided for pivotally interconnecting the handle means of the handle means sets in driving relation with the head means to effect its movement on the surface, and wheel means are associated with the one handle means and spaced from the pivotally interconnecting means for engagement with the surface to support the one handle means when the handle means sets are arranged in the articulated relation in the extended positions thereof, respectively.

In still another form of the invention, a cleaning head is provided for delivering a fluid under pressure from a source thereof onto a surface having foreign particles thereon. The cleaning head has housing means for receiving the fluid under pressure from the source, and means is associated with the housing means for spraying the fluid under pressure onto the surface to dislodge at least some of the foreign particles therefrom. A plurality of bristle means are mounted on the housing means with at least some of the bristle means being seated on the surface thereby to define with the housing means a chamber about the spraying means, and the bristle means are operable generally for at least in part obviating splashing of the sprayed fluid from the chamber exteriorly of the cleaning head. The bristle means also define a plurality of passage means at least generally adjacent the surface for displacement flow of the sprayed fluid and the at least some dislodged foreign particles from the chamber exteriorly of the cleaning head through the passage means.

In yet another form of the invention, another cleaning head is provided for delivering a fluid under pressure onto a surface having foreign particles thereon. This cleaning head has a housing with means mounted thereto for receiving the fluid under pressure from the source, and the receiving means includes a rotatable member. A set of rotatable means on said rotatable means for conjoint rotation therewith are connected in fluid communication with said fluid receiving means. A set of means are provided on said rotatable means for spraying the fluid under pressure onto the surface to dislodge therefrom at least some of the foreign particles, respectively, and a set of other means on said rotatable means are provided for spraying the fluid under pressure in a direction to impel the conjoint rotation of said rotatable means and said rotatable member. A plurality of bristle means are associated with the housing and arranged for seating engagement on the surface thereby to define with the housing a chamber generally about the rotatable means, and said bristle means are operable generally for at least in part obviating splashing of the sprayed fluid from the chamber exteriorly of the cleaning head. The bristle means also define a plurality of passage means at least generally adjacent the surface for the displacement flow of the sprayed fluid and the at least some dislodged foreign particles from the chamber of the cleaning head through the passage means.

BRIEF DESCRIPTION OF THE DRAWINGS

Corresponding reference characters indicate corresponding parts throughout the several views of the drawings.

The exemplifications set out herein illustrate the preferred embodiments of the invention in several forms thereof and such exemplifications are not to be construed as limiting the scope of the disclosure or the scope of the invention in any manner.

DETAILED DESCRIPTION OF THE PREFERRED EMBODIMENTS

Figure 6:
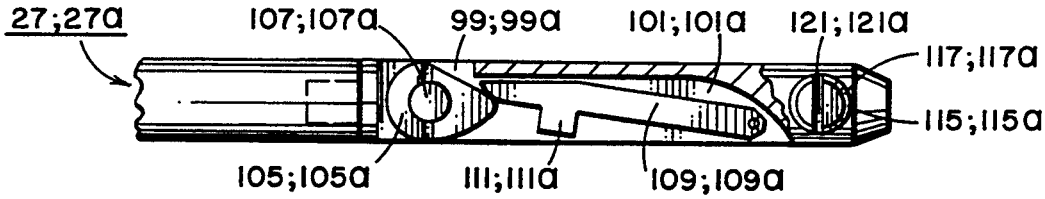
FIG. 6 is a sectional view taken along line 6—6 in FIG. 5.
Figure 7:
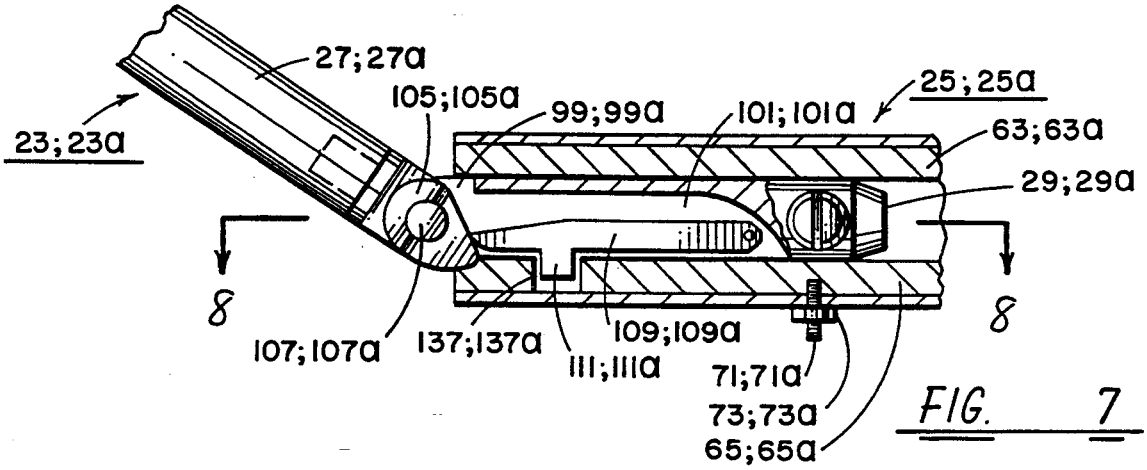
FIG. 7 is an enlarged fragmentary view taken from FIG. 2 and illustrating in partial cross-section the extendable handle in its extended position.
Figure 8:
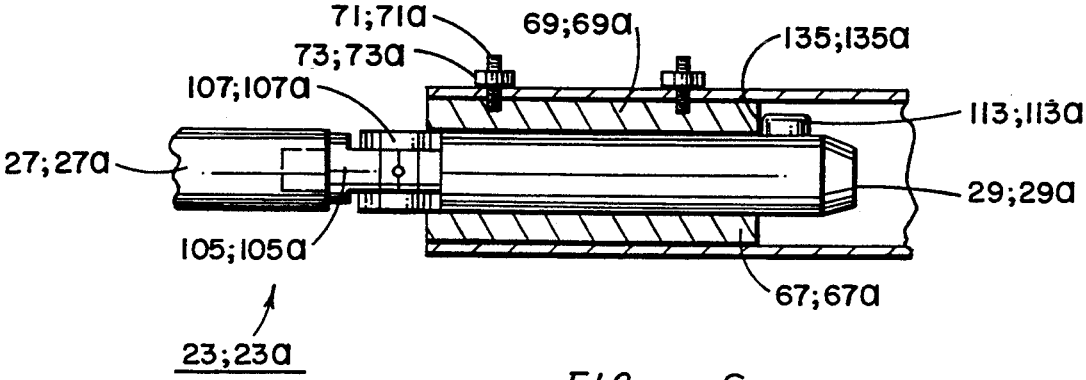
FIG. 8 is a sectional view taken along line 8—8 in FIG. 7 but showing an articulated part of the extendable handle pivotally displaced when the extendable handle is in its extended position.

With reference now to the drawings in general, there is illustrated in one form of the invention an extendable handle 21 (FIGS. 1–8) having a pair of sets of handles or handle means, such as slides or slide members 23, **23*a* and 25,25*a*, arranged at least in part in telescoping relation and spaced generally side-by-side with respect to each other for relative sliding or axial movement between a collapsed or at-rest position and an extended position (FIGS. 1–3, 7 and 8). Slides 23,23*a* comprise a pair of sets of articulated means or slide rods 27,29 and 27*a*,29*a* arranged for relative pivotal movement, and articulated means 27,27*a* extend exteriorly of slides 25,25*a* when the slide sets 23,23*a* and 25,25*a* are in the extended positions thereof, respectively (FIGS. 1, 2, 7 and 8). A set of releasable engagement means 31,31*a* are associated with slides 25,25*a* for releasable engagement with slides 23,23*a* to releasably retain the slide sets 23,23*a* and 25,25*a* against displacement from the collapsed positions thereof, respectively (FIGS. 1, 2 and 4) and interlocking means 33,33*a* associated with articulated means 29,29*a* are operable generally in response to the pivotal movement of articulated means 27,27*a* for interlocking articulated means 29,29*a* and slides 25,25*a* in the extended positions thereof, respectively (FIGS. 7 and 8**).

Figure 2:
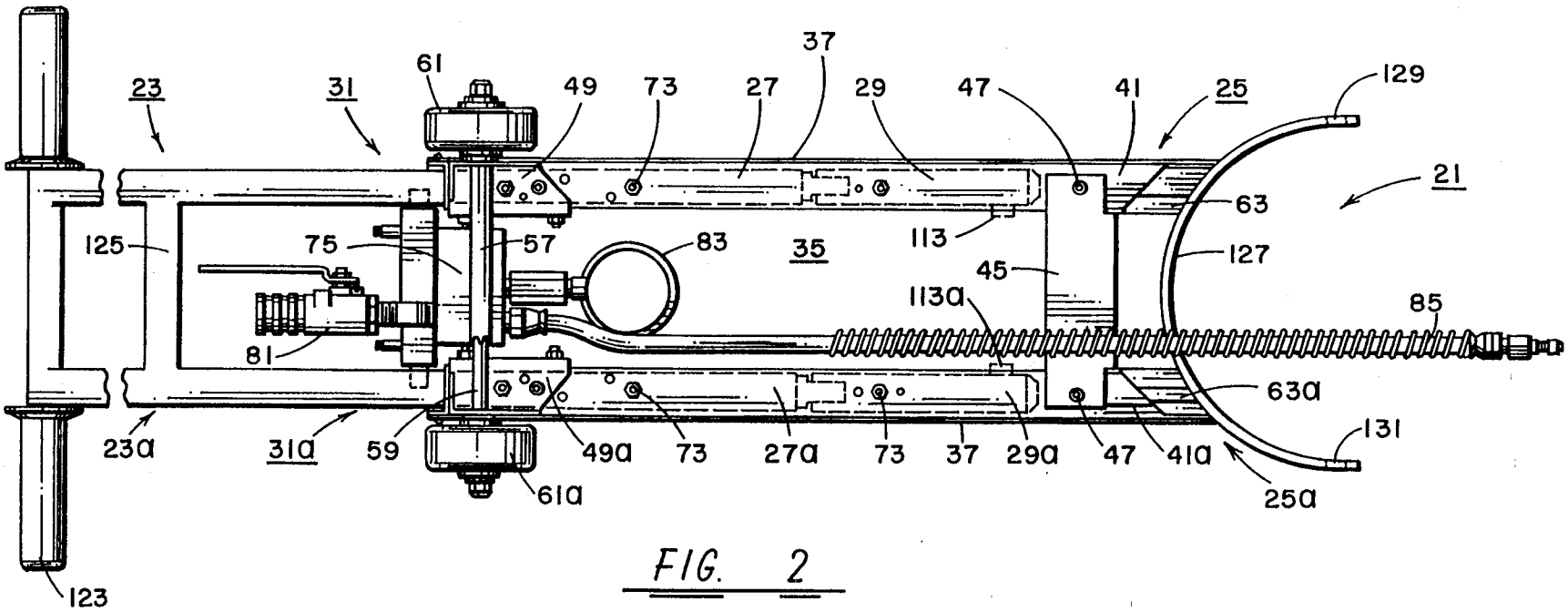
FIG. 2 is a bottom view of the extendable handle of FIG. 2.
Figure 1:
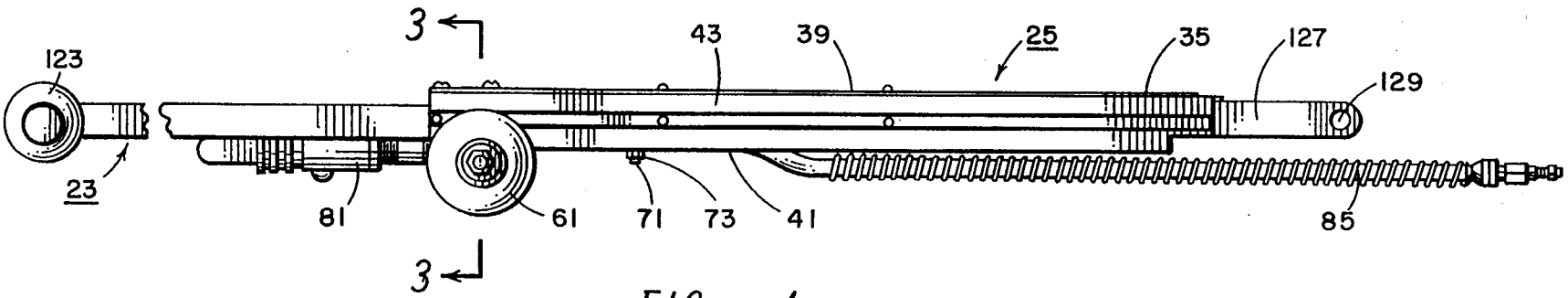
FIG. 1 is a side elevational view illustrating an extendable handle in one form of the invention in its collapsed or at-rest position.
Figure 3:
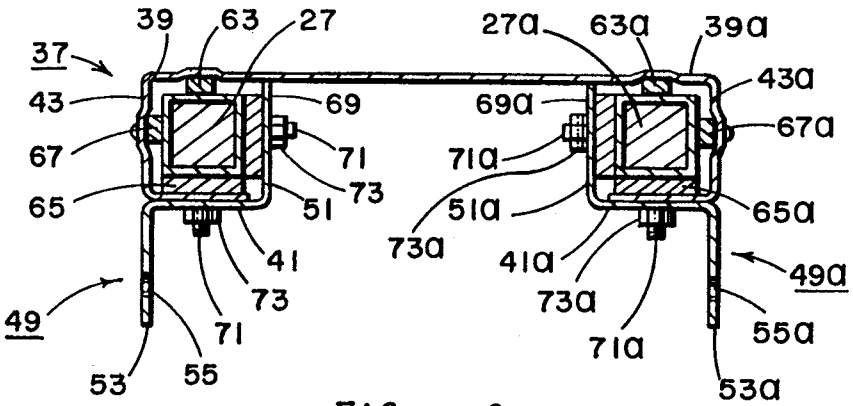
FIG. 3 is an enlarged partial sectional view taken along line 3—3 in FIG. 1.

Referring now with particularity to FIGS. 1–3, a cover 35 formed of a metallic sheet material, such as aluminum or the like for instance, is integrally provided with a pair of generally opposed C-shaped channels **37,37*a* which in part respectively define slides 25,25*a*. Channels 37,37*a* are respectively provided with a pair of generally opposed sidewalls 39,41 and 39*a*,41*a* integrally interconnected by an intermediate sidewall 43,43*a*, as best seen in FIG. 3, and it may be noted that the channels extend along at least a major section of the entire length or side portions of cover 35. A strengthening strap 45 is interconnected between sidewalls 41,41*a* of channels 39,39*a* adjacent one of the opposite ends of cover 35 by suitable means, such as for instance rivets 47, and a pair of generally Z-shaped brackets 49, 49*a* are fixedly secured to sidewalls 41,41*a* of channels 37,37*a* at least generally adjacent the other opposite end of cover 35 by suitable securing means well known to the art, such as rivets or the like for instance (not shown). Brackets 49,49*a* are provided with a pair of integral oppositely extending legs 51,53 and 51a,53*a*, and legs 51,51*a* extend generally across opposite sidewalls 39,41 and 39*a*,41*a* of channels 37,37*a* in opposed relation with intermediate sidewalls 43,43*a* thereby to enclose the channels along a minor portion of the lengths thereof. Legs 53,53*a* of brackets 49,49*a* are provided with a pair of aligned openings 55,55*a*, and an axle housing 57 extends through the openings rotatably receiving an axle 59 supporting a pair of opposite wheels or wheel means 61,61*a* disposed adjacent channels 37,37*a***, respectively.

As best seen in FIGS. 2 and 3, a pair of sets of abutment or guide means, such as guides 63,65,67,69 and **63*a*,65*a*,67*a*,69*a* are respectively disposed adjacent channel sidewalls 39,41,43 and 39*a*,41*a*,43*a* and bracket legs 51,51*a*. The guides are formed of metallic strips which are coated at least in part with "Teflon"; however, it is contemplated that the guides may be formed of material other than metal or may be coated with other coating materials within the scope of the invention. Guides 63,67 and 63*a*,67*a* extend generally the entire length of channels 37,37a while guides 65,69 and 65a,67a are predeterminately shorter in length, as discussed hereinafter. Guides 63,65 and 63a,65a are respectively fixedly secured to channel sidewalls 39,43 and 39a,43a by suitable adhesive means or mechanical means well known to the art (not shown), and it may be noted that guides 67,67a and 69,69a are adjustably mounted to channel sidewalls 41,41a and bracket legs 51,51a, respectively. Guides 67,69 and 67a,69a include a set of integral threaded extensions 71,71a which extend through a set of openings (not shown) provided therefor through channel sidewalls 41,41a and bracket legs 51,51a, and a set of lock nuts 73,73a are adjustably threadedly received on the threaded extensions and abutted with channel sidewalls 41,41a and bracket legs 51,51a**, respectively, as further discussed hereinafter.

Figure 4:
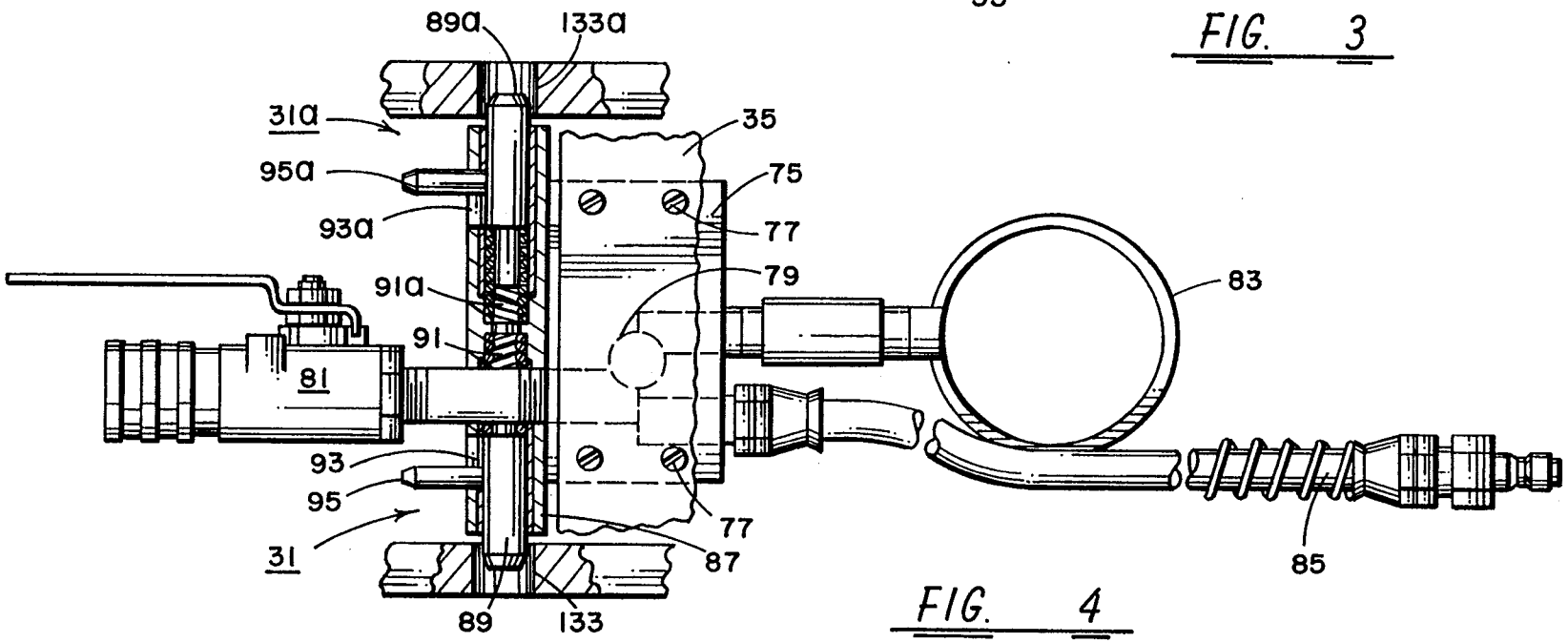
FIG. 4 is an enlarged partial plan view illustrating in cross-section a releasable means of the extendable handle.

A pressure fluid connection block 75 is fixedly secured by suitable means, such as a plurality of screws 77 or the like for instance, to cover 35, as shown partially broken away in FIG. 4, and passage means 79 (as shown in dotted outline) are provided in the connection block for interconnecting an ON-OFF valve 81 in pressure fluid communication with a pressure gauge 83 and a conduit, such as for instance an armored hose 85 or the like for instance. Of course, valve 79 is adapted for connection with a source of fluid under pressure (not shown) and may be manually operated between its ON-OFF positions to selectively connect gauge 81 and hose 83 in pressure fluid communication with such source and to interrupt such pressure fluid communication.

Connection block 75 also defines a casing 87 having a set of generally opposed detents 89,89a slidable therein between at-rest and displaced positions, and the detents are resiliently urged toward their at-rest positions by a set of resilient means, and as springs 91,91a for instance, which are interposed between the pistons and the casing, respectively. A pair of generally elongate slots 93,93a are provided in casing 87, and a pair of stems 95,95a carried by detent 89,89a extend through the slots exteriorly of the casing, respectively. Of course, the resilient forces of springs 91,91a acting on detents 89,89a urge them toward their at-rest position with portions of the detents extending beyond casing 87 exteriorly thereof and also urge stems 95,95a into engagement with slots 93,93a thereby to retain the detents against displacement from the casing, respectively.

Articulated slide rods 27,29 and 27a,29a are generally square in cross-section being formed of a suitable metallic material, such as aluminum or the like for instance, FIGS. 1–3, and confronting parts of the slide rods are disposed for respective sliding, or gripping and guiding relation or engagement with guides or abutment means 63–69 and 63a–69a, arranged in cover 35 in the manner discussed above. Further, when articulated slide rods 27,27a and 29,29a are received in association with guides 63–69 and 63a–69a, lock nuts 73,73a may be threadedly engaged with threaded extensions 71,71a on guides 67,69 and 67a,69a in the manner discussed hereinabove to adjustably move them for effecting the desired sliding and guiding relation of the guides with confronting parts on the articulated slide rods. Thus, the adjusting association of lock nuts 73,73a with threaded extensions 71,71a on guides 67,69 and 67a,69a comprise sets of adjusting means arranged with cover 35 and guides 67,69 and 67a,69a for adjustably urging the guides into slidable gripping engagement with confronting parts on articulated slide rods 27,27a and 29,29a, respectively.

Figure 5:
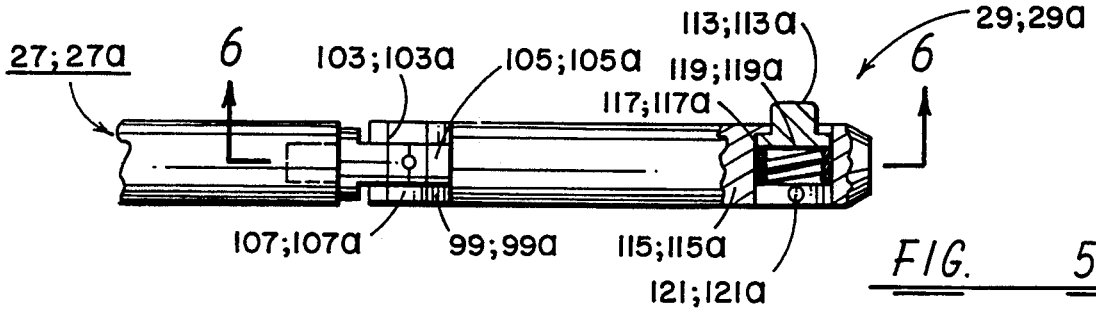
FIG. 5 is an enlarged fragmentary plan view showing one of the sets of articulated means of the extendable handle of FIG. 2 partially in cross-section and disassociated from the extendable handle.

As seen in FIGS. 5 and 6, only the component parts of articulated slide rods 27,29 are shown with the reference numerals for the like component parts of slide rods 27a,29a being shown in FIGS. 5 and 6 for the purpose of drawing simplification. A set of cross-slots 99,101 and 99a,101a are provided in slide rods 29,29a intersecting the articulated ends thereof, and a set of aligned openings 103,103a in slide rods 29,29a intersect cross-slots 99,99a thereof, respectively. The articulated ends of slide rods 27,27a are defined by a set of cams or cam means 105,105a secured onto the slide rods for conjoint movement therewith by suitable means, such as press-fitting or the like for instance, and the cams are arranged to extend into cross-slots 99,101 and 99a,101a of slide rods 29,29a, respectively. A set of pivot pins 107,107a are fixedly pinned to cams 105,105a and the pivot pins are pivotally received in aligned openings 103,103a of slide rods 29,29a thereby to pivotally interconnect the articulated ends of slide rods 27,29 and 27a,29a, respectively.

Interlocking means, such as a set of pawls or cam follower means 109,109a are pinned to slide rods 29,29a for a pivotal movement within cross-slots 101,101a thereof, and the cam followers are arranged in following engagement with cams 105,105a for following or pivotal movement therewith between at-rest or cammed positions and locking positions, respectively. Cam followers 109,109a include a set of locking means, such as depending locking fingers 111,111a or the like for instance, for interlocking in engagement with handle means 25,25a, as discussed in greater detail hereinafter.

A set of stepped detents 113,113a are slidably arranged in a set of stepped bores or openings 115,115a provided through slide rods 29,29a adjacent the free ends thereof, and the compressive forces of a set of resilient means, such as springs 117,117a for instance, has the stepped detents toward abutment with a set of shoulders 119,119a formed in the stepped openings thereby to retain the stepped detents against displacement from the stepped openings, respectively. Springs 117,117a are resiliently contained in the larger of stepped openings 115,115a between stepped detents 113,113a and a set of suitable spring retaining means, such as retaining pins 121,121a or the like for instance, fixedly received in slide rods 29,29a to extend across the larger of the stepped openings, respectively. When stepped detents 113,113a are resiliently urged into their at-rest positions toward engagement with shoulders 119,119a, the stepped detents extend in part exteriorly of slide rods 29,29a, and the stepped detents are arranged in opposed facing relations to each other in slide rods 29,29a, as may be seen in FIG. 1, for releasable engagement with a confronting part on handle means 25a thereby to releasably retain handle means 23,25a against displacement when in the extended positions thereof, as may be seen in FIG. 8 and discussed in greater detail hereinafter.

To complete the description of extendable handle 21, an operator grip or cross-bar 123 and a strengthening cross-bar 125 are integrally interposed between slide rods 27,27a, and a yoke 127 having a set of aligned openings 129,131a therein is secured to cover 35 of handle means 25,25a by suitable means, such as a plurality of welds or rivets or the like for instance (not shown).

When handle means 23,23a and 25,25a of extendable handle 21 are arranged in part in telescoping relation in the collapsed positions thereof, as may be seen in FIGS.

1 and 2, the compressive force of springs 91,91a in casing 87 of connection block 75 resiliently urge detents 89,89a toward their at-rest positions extending in part beyond the casing into releasable engagement with a set of aligned openings 133,133a in slide rods 27,27a, respectively, (FIG.4). Thus, detents 89,89a define releasable means or resiliently urged means for releasable engagement with handle means 23,23a to releasably retain handle means sets 23,23a and 25,25a against displacement from the collapsed positions thereof, respectively.

To effect relative movement of handle means 23,23a and 25,25a from their collapsed positions into the extended positions thereof, operator or manually applied forces exerted on stems 95,95a act to slidably move detents 89,89a against the compressive forces of springs 91,91a into displaced positions in casing 87 thereby to disengage the detents from openings 133,133a in slide rods 27,27a. Upon the disengagement of detents 89,89a from openings 133,133a in slide rods 27,27a, as discussed above, another operator or manually applied force may be exerted on handle means 23,23a moving it relative to handle means 25,25a toward the extended positions of handle means sets 23,23a and 25,25a, as may be seen in FIGS. 7 and 8. During this relative movement of handle means sets 23,23a and 25,25a to the extended positions thereof, openings 133,133a in slide rods 27,27a are displaced from alignment with detents 89,89a, and the applied forces on detent stems 95,95a may be released wherein the compressive forces of springs 91,91a urge the detents into sliding engagement with confronting parts on slide rods 27,27a.

When handle means 23,23a and 25,25a are in the extended positions thereof, as seen in FIG. 7, detents 113,113a engage a set of abutments or abutment means 135,135a provided on guides 69,69a, as best seen in FIG. 8. Thus, detents 89,89a define a set of releasable means or resiliently urged means for abutment with confronting abutments 135,135a of guides 69,69a on handle means 25,25a to releasably retain handle means sets 23,23a and 25,25a against displacement beyond the extended positions thereof, respectively. With handle means 23,23a in its extended position, guides 63–69 and 63a, 69a in handle means 25,25a are disposed in gripping relation with confronting parts on articulated slide rods 29,29a, and articulated slide rods 27,27a extend at least in part exteriorly of handle means 25,25a; therefore, slide rods 27,27a may be manually pivotally movable on pivot pins 107,107a pivotally received in aligned openings 103,103a provided therefor in slide rods 29,29a, respectively. Cams 105,105a are conjointly pivotally movable with slide rods 27,27a relative to slide rods 29,29a, and cam followers 109,109a are pivotally movable in slide rods 29,29a to follow the pivotal movement of the cams, respectively. In response to the following pivotal movement of cam followers 109,109a, locking fingers 111,111a on the cam followers are moved into interlocking engagement with a set of openings 137,137a provided therefor in guides 65,65a, respectively. Thus, cam followers 109,109a associated with slide rods 29,29a are operable generally in response to the relative pivotal movement of slide rods 27,27a for interlocking slide rods 29,29a and handle means 25,25a in the extended positions thereof, respectively.

If separation of handle means 23,23a and 25,25a is desired prior to the above discussed relative pivotal movement of slide rods 27,27a to effect the interlocking engagement of cam followers 109,109a, operator or manually applied releasing forces may be exerted on detents 113,113a moving them toward depressed positions within slide rods 29,29a against the compressive forces of springs 117,117a thereby to pass the detents over abutments 135,135a on guides 69,69a in response to the separation movement of slide rods 27,27a and 29,29a from handle means 25,25a when the slide rods are disposed in generally aligned relation, respectively.

Figure 9:
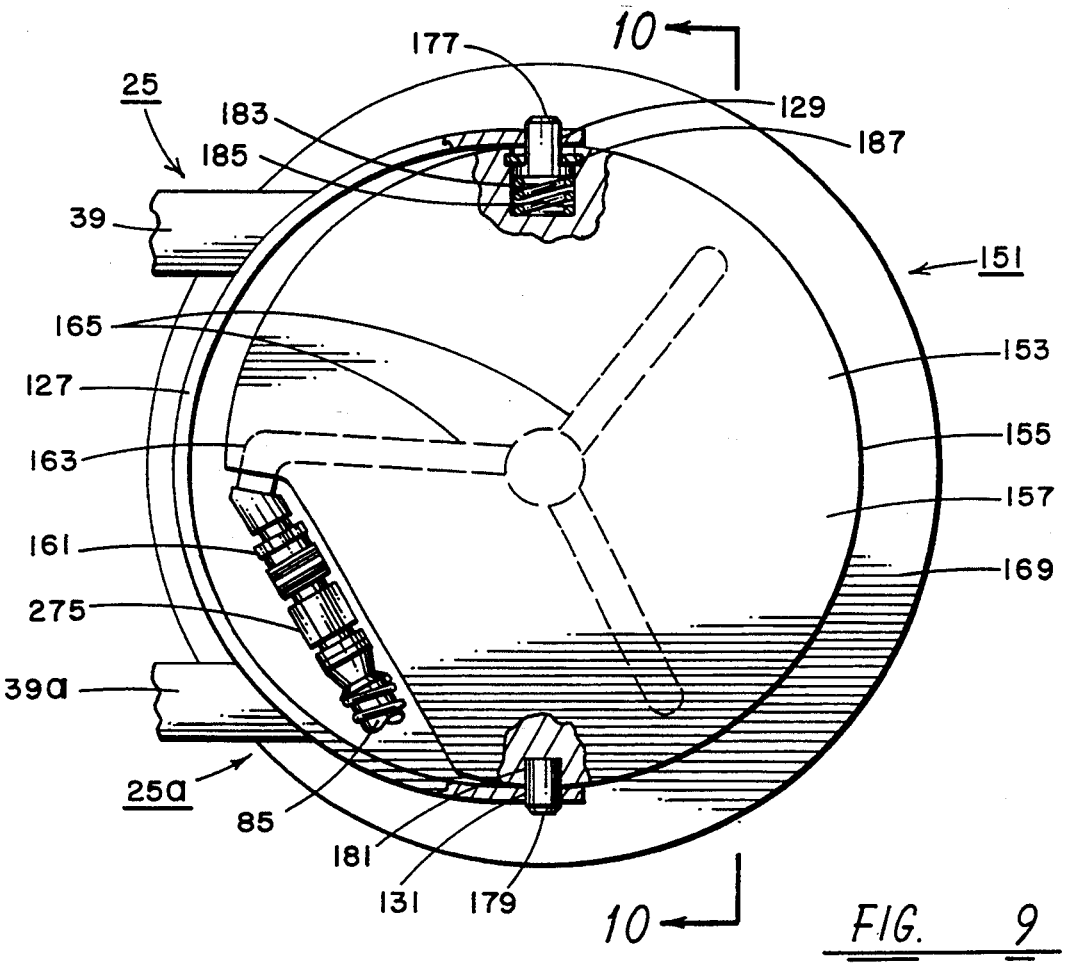
FIG. 9 is a partial plan view of a cleaning head in one form of the invention.
Figure 10:
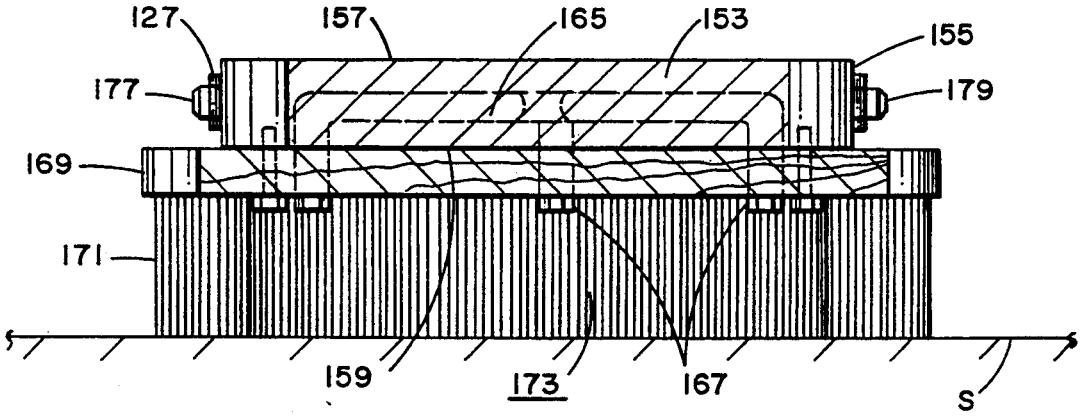
FIG. 10 is a sectional view taken along line 10—10 in FIG. 9 and illustrating the cleaning head seated on a surface to be cleaned.
Figure 11:
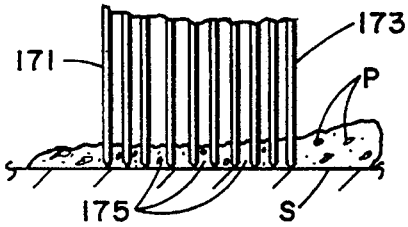
FIG. 11 is an enlarged partial sectional view taken from FIG. 10 and illustrating the displacement flow of sprayed fluid from the cleaning head and foreign particles dislodged from the surface through a plurality of passages defined between the bristle means of the cleaning head seated on the surface.

With reference now to FIGS. 9–11, there is illustrated in one form of the invention a cleaning head or head means 151 having a housing or housing means 153 for receiving the fluid under pressure from the source thereof (not shown), and the housing comprises a generally flat plate having a peripheral surface 155 interposed between a pair of generally planar opposite surfaces 157,159. A quick-connect fitting 161 for connection to the source of fluid under pressure is communicated with an inlet or inlet port means 163 intersecting peripheral surface 155 of housing 153; however, it is contemplated that various other connectors different than the quick-connect fitting may be utilized with housing 153. A plurality of interconnected passage or passage means 165 intersecting opposite surface 159 of housing 153 are arranged in fluid communication with inlet 163 thereof, and spraying means, such as a plurality of nozzles 167 or the like for instance, are associated with the housing being threadedly or otherwise removably secured in the passages adjacent opposite surface 159. Nozzles 167 are arranged in a preselected array on housing 153 and predeterminately directed for spraying the fluid under pressure onto a surface S in a preselected pattern to dislodge therefrom foreign particles P, as best seen in FIG. 11 and further discussed hereinafter.

A generally annular plate 169 is removably secured by suitable means, such as a plurality of screws (not shown) or the like for instance to housing 153 adjacent opposite surface 159 thereof so as to extend generally radially outwardly thereof, and the annular plate may be formed of any suitable material, such as for instance wood or a plastic or the like. A plurality of bristles or bristle means 171 are mounted in a generally annular array thereof onto annular plate 169 so as to extend therefrom so that at least some of the bristles may be seated on surface S to support cleaning head 151 thereon, as seen in FIG. 10, and the bristles may be formed of any suitable material, such as a fiber or a plastic or the like for instance. Thus, bristles 171 are associated with housing 153 and may be seated against surface S so as to define with the housing a chamber 173 about nozzles 167; therefore, when fluid under pressure is sprayed by nozzles 167 onto surface S, as previously mentioned, the bristles are operable generally for at least in part obviating splashing of the sprayed fluid from the chamber exteriorly of cleaning head 151. It may be noted that the interstices between adjacent bristles 171 define a plurality of passage means 175 at least generally adjacent surface S for the displacement flow of the sprayed fluid and at least some of the dislodged foreign particles P from chamber 173 exteriorly of cleaning head 151 through passage means 175 (as best seen in FIG. 11).

A pair of pivotally interconnecting means, such as generally opposed pivot pins 177,179 or the like for instance, on housing 153 extend generally radially outwardly from peripheral surface 155 thereof, and the pivot pins are received in a pair of generally opposite diametrically arranged blind bores or openings 181,183 in the housing intersecting the peripheral surface, respectively. Pivot pin 177 is stationary being fixedly secured in opening 181 by suitable means, such as a press-fit or the like for instance, and pivot pin 159 is movable being in part slidable in opening 183. Resilient means, such as a spring 185 or the like for instance, in opening 183 is biased between housing 153 and pivot pin 179, and to complete the description of cleaning head 151, the compressive force of the spring acting on the pivot pin urges toward a biased position into displacement preventing engagement with retaining means, such as a C-washer 187 or the like for instance, releasably received in opening 183.

Figure 12:
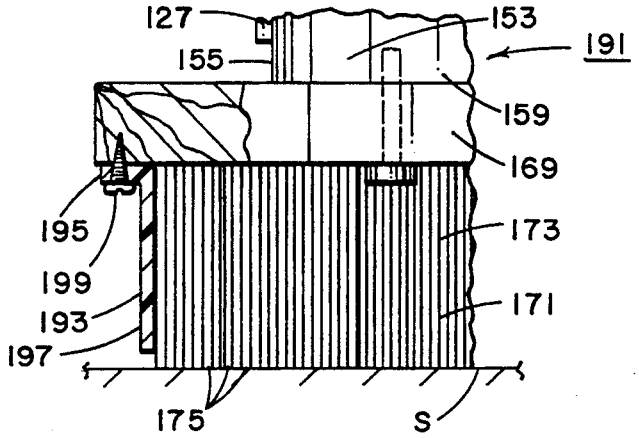
FIGS. 12 and 13 are enlarged fragmentary views illustrating alternative embodiments in one form of the invention, respectively, and similar to the cleaning head of FIG. 9.

In FIG. 12, an alternative cleaning head or head means 191 is illustrated in one form of the invention having generally the same component parts and functioning generally in the same manner as the previously discussed cleaning head 151 with the exceptions noted below.

A generally annular shield or shield means 193 extends generally about bristles 171 for at least assisting the bristles in at least in part obviating the splashing of the sprayed fluid from chamber 173 exteriorly of cleaning head 191. A pair of generally opposite annular end positions 195,197 are provided on shield 193 with opposite end portion 195 defining a generally annular radially extending flange retained in releasable securement to plate 169 by suitable means, such as a plurality of screws 199 or the like for instance. Opposite annular end portion 197 on shield 193 is predeterminately spaced from surface S and passage means 175 so as to at least not impair the displacement flow of the sprayed fluid and dislodged foreign particles from chamber 173 exteriorly of cleaning head 191 through passage means 175, as previously discussed. To complete the description of cleaning head 191, shield 193 may be formed of any suitable plastic material; however, it is contemplated that other shields formed of materials other than plastic may be utilized within the scope of the invention.

Figure 13:
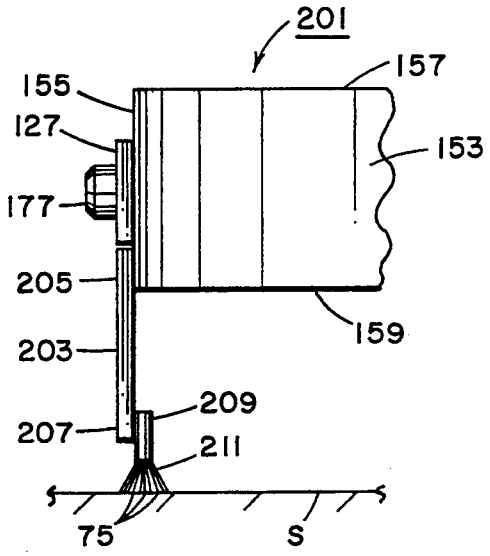
Figure 15:
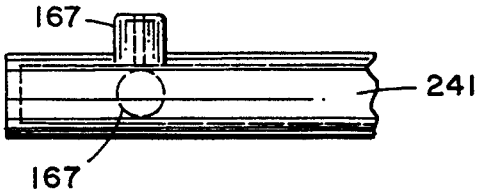
FIG. 15 is a sectional view taken along line 15—15 in FIG. 14.

In FIG. 13, another alternative cleaning head or head means 201 is illustrated in one form of the invention having generally the same component parts and functioning generally in the same as the previously described cleaning head with the exceptions noted below.

A generally annular shield or shield means 203 is provided with a pair of generally annular opposite end portions 205,207, and opposite end portion 205 is secured about peripheral surface 155 of housing 153 by suitable means, such as for instance an adhesive or a plurality of screws (not shown). An annular strip 209 is secured by suitable means, such as an adhesive or the like for instance (not shown) to shield 203 adjacent annular opposite end portion 207 thereof, and a generally annular array of bristles or bristle means 211 are provided on the annular strip for seating in engagement with surface S to support cleaning head 201 thereon. Thus, shield 203 and strip 209 define with housing 153 the chamber 173 about nozzles 167 thereby to at least in part obviate the splashing of the sprayed fluid from the chamber exteriorly of cleaning head 201, and the interstices between bristles 211 define passage means 175 to accommodate the displacement flow of the sprayed fluid and dislodged foreign particles from the chamber exteriorly of the cleaning head in the manner discussed hereinbefore.

Figure 14:
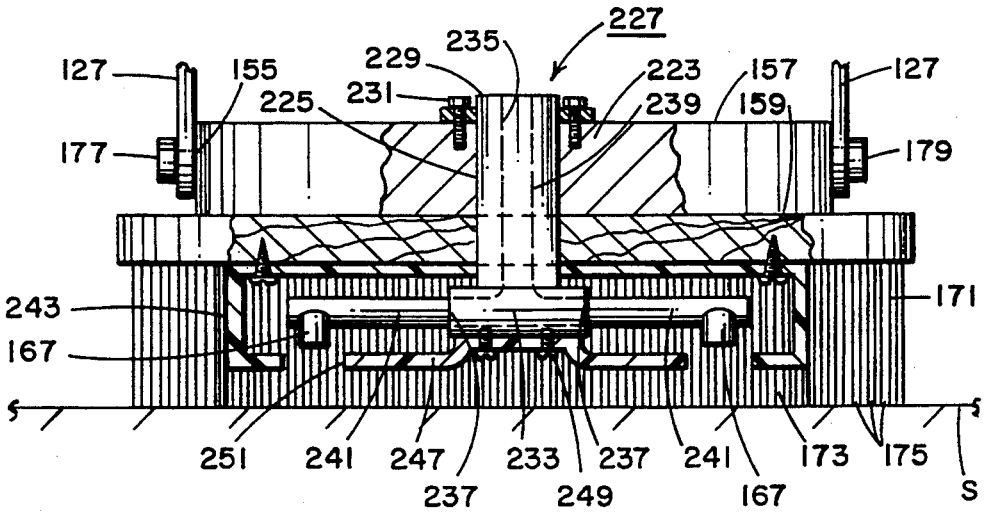
FIG. 14 is a sectional view showing another alternative embodiment of a cleaning head in one form of the invention.
Figure 16:
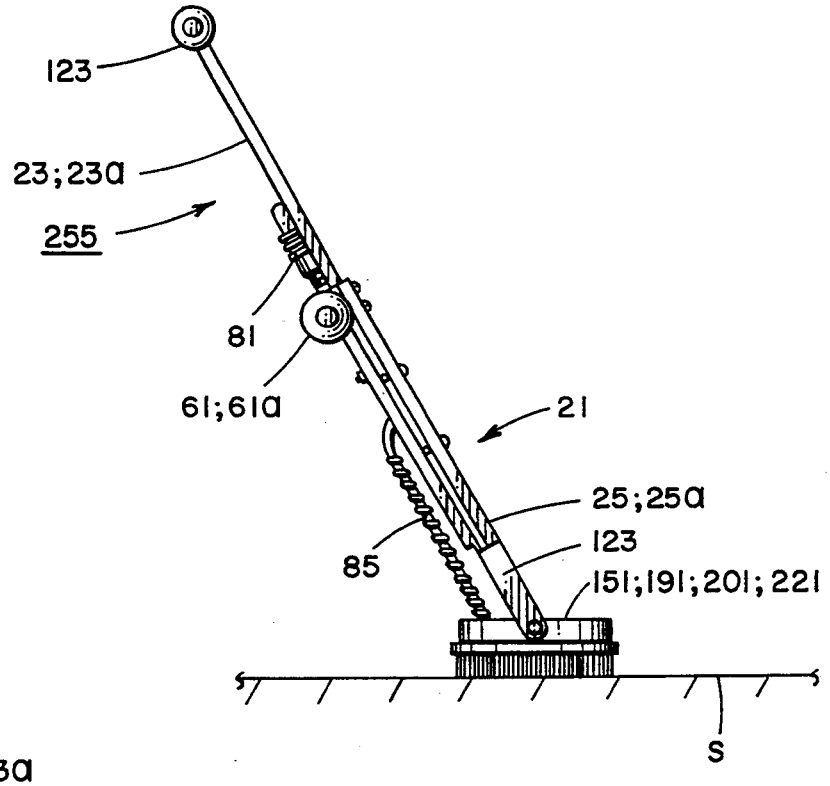
FIGS. 16 and 17 are respective side elevational views of a cleaning device in one form of the invention.

In FIG. 14, still another alternative cleaning head or head means 221 is illustrated in one form of the invention having generally the same component parts and functioning generally in the same manner as the previously discussed cleaning head 151 with the exceptions noted below.

Cleaning head 221 is provided with a generally annular housing or housing means 223 having peripheral surface 155 interposed between opposite surfaces 157,159, and a generally central mounting opening 225 is provided through the housing intersecting the opposite surfaces thereof. A rotating union 227 has a body 229 extending through central mounting opening 225 and secured against displacement to housing 223 by suitable means, such as a plurality of screws 231 or the like for instance. Rotatable means or member 233 is rotatably mounted on body 229 for rotating relative thereto, and the rotatable member is disposed within chamber 173 in spaced apart relative from opposite surface 159 on housing 223. An inlet port or inlet means 235 is provided in housing 223 for connection with the source (not shown) of fluid under pressure and a set of outlet ports or outlet means 237 are provided in rotatable member 233. Albeit not shown for purposes of drawing simplification, quick-connect fitting 161 may be associated with inlet port 235 for connecting it in communication with the source (not shown) of fluid under pressure. Thus, rotating union 227 comprises means mounted to housing 223 for receiving the fluid under pressure from the source thereof. Passages or passage means 239 in body 229 and rotatable member 233 communicate outlet ports 237 with the fluid under pressure at inlet port 235, and a set of rotatable means, such as tubular arms 241 or the like for instance, for conjoint rotation with rotatable member 233 are respectively received in the outlet ports in fluid communication therewith so as to extend generally radially outwardly from the rotatable member within chamber 173. A set of spraying means or nozzles 167 carried in tubular arms 241 are effective to spray the fluid under pressure onto surface S to dislodge foreign particles P therefrom in the manner previously discussed, and another set of spraying means or nozzles 167 carried in the tubular arms are aimed or otherwise arranged for spraying the fluid under pressure in a predetermined direction within the chamber to rotatably impel the tubular arms and rotatable member effecting the conjoint rotation thereof. Rotating union 227 is manufactured by the Deublin Co., Waukegan, Ill. as model 927-190-191.

If desired, a generally annular shield or shield means 243 may be secured to plate 169 by suitable means, such as a plurality of screws 245 or the like for instance, and arranged or positioned so as to extend generally annularly between bristle 171 and tubular arms 241 in order to prevent the possibility of interfering engagement therebetween. Further and also if desired, a generally disc shaped shield or shield means 247 may be mounted by suitable means, such as a plurality of screws 249 or the like for instance, to rotatable member 233 of rotating union 227 for conjoint rotation therewith within chamber 173, and shield 247 is interposed between surface S when bristles 171 are seated thereon and both rotatable member 233 and at least a part of tubular arms 241 in protective relation therewith. A peripheral surface or edge portion 251 on shield 247 may extend or be disposed in predetermined radial spaced relation from shield 243 to define therebetween a generally annular opening 253 accommodating the passage therethrough of the sprayed fluid from the sets of nozzles 167 on tubular arms 241. Shields 243,247 may be formed of a plastic material; however, it is contemplated that other shields having other shapes and formed of other materials different than those discussed above with respect to shield 243, 247 may be utilized within the scope of the invention.

Referring now to FIGS. 1, 9, 16 and 17, the above discussed extendable handle 21 is illustrated in releasable pivotal interconnection and in driving relation with a cleaning head, such as for instance any one of the above discussed cleaning heads 151,191,201,221 or the like (see FIGS. 9 and 12–17), thereby to define a cleaning device 255 in one form of the invention. For the purpose of brevity of disclosure and drawing simplifications, cleaning device 255 will be discussed with respect to the combination of cleaning head 151 and extendable handle 21; however, it is contemplated that extendable handle may be releasably pivotally interconnected in driving relation with various other cleaning heads different than those discussed above within the scope of the invention.

To effect the releasible pivotal interconnection of extendable handle 21 and cleaning head 151, an applied force may be exerted on movable pivot pin 179 to depress it at least in part into opening 181 in housing 153 of the cleaning head against the compression force of spring 185 acting on the movable pivot pin, FIG. 9. When movable pivot pin 177 is so manually depressed into opening 181, aligned opening 129 in yoke 127 of extendable handle may be pivotally received on stationary pivot pin 179 on housing 153 of cleaning head 151, and aligned opening 131 in the yoke may be at least in part located to receive movable pivot pin 177. Thereafter, the applied force exerted on movable pivot pin 177 may be removed, and the compressive force of spring 185 returns the movable pivot pin into its biased position extending the movable pivot pin through aligned opening 131 in yoke 127 into pivotal interconnection therewith. Thus, when extendable handle 21 is in either its collapsed position or its extended position, as previously discussed, the pivotal interconnection of pivot pins 177,179 on hand 151 with yoke 127 of the extendable handle comprises releasable means for pivotally interconnecting handle means 25,25*a* of the extendable handle in driving relation with the cleaning head for moving the cleaning head along a desired cleaning path on surface S in response to an operator applied force exerted on cross-bar 123 of handle means 23,23*a* of this extendable handle, as may be seen in FIG. 16 and 17. Of course, when extendable handle 21 and cleaning head 151 are pivotally interconnected, as discussed above, a mating quick-connect fitting 257 on hose 85 of the extendable handle may be connected or otherwise engaged in fluid communication with quick-connect fitting 161 on housing 153 of the cleaning head, as seen in FIG. 9.

Figure 17:
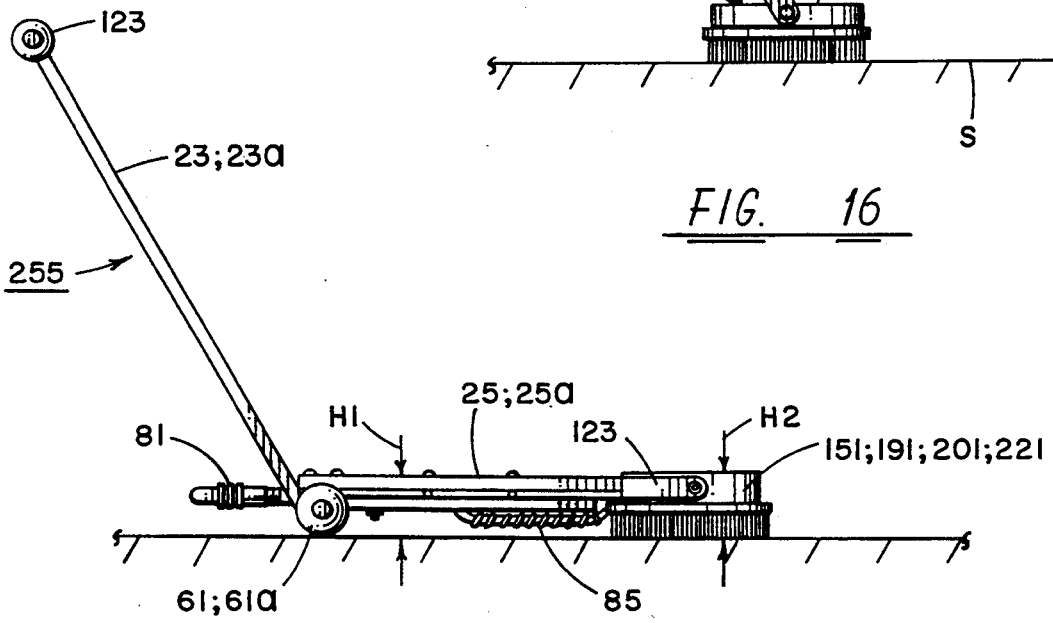

With reference to FIG. 17, when extendable handle 21 is in its extended position and pivotally interconnected with cleaning head 151 as previously discussed, it may be noted wheels 61,61*a* carried on handle means 25,25*a* of the extendable handle may also be seated on surface S along with the cleaning head. When wheels 61,61*a* so engage surface S, both handle means 25,25*a* of the extendable handle and cleaning head 151 may be extended beneath various structures, such as for instance shelving or the like (not shown) spaced adjacent surface S, for moving the cleaning head along a desired cleaning path on surface S beneath such structure in response to an operator applied force exerted on cross-bar 123 of handle means 23,23*a* of the extendable handle. Thus, with wheels 61,61*a* and cleaning head 151 of cleaning device 155 both seated on surface S, it may be noted that spacing of a part on handle means 25,25*a* defining its maximum height H1 above surface S is no greater than the spacing of a part on cleaning head 151 defining its maximum height H2 above surface S.

From the foregoing, it is now apparent that a novel extendable handle 21, novel cleaning heads 151, 191,201,221, and a novel cleaning device 255 have been presented, and it is contemplated that changes as to the precise configuration, arrangements and details of the components utilized in such extendable handle, cleaning heads and cleaning devices may be made by those having ordinary skill in the art without departing from the spirit of the invention or the scope thereof as defined by the claims which follow.

What is claimed is:

1. A cleaning device for delivering a fluid under pressure from a source thereof onto a surface having foreign particles thereon, the cleaning device comprising:

head means for communication with the source and movably seated on the surface for spraying the fluid under pressure onto the surface to dislodge therefrom at least some of the foreign particles;

a pair of sets of handle means arranged in part in telescoping relation in at-rest positions and operable generally for extension from the at-rest positions into extended positions with said handle means of said handle means sets being arranged in articulated relation only in the extended positions thereof, respectively;

releasable means for pivotally interconnecting one of the handle means of said handle means sets about a horizontal axis in driving relation with said head means to effect its movement on the surface; and wheel means coupled to said one handle means and spaced from said pivotally interconnecting means for engagement with the surface to support said one handle means adjacent an end distal from said head means when said handle means sets are arranged in the articulated relation in the extended positions thereof, respectively.

2. The cleaning device as set forth in claim 1 wherein said head means includes a part which defines a preselected maximum height of an upper extremity of said head means above the surface, and said one handle means including another part which defines another preselected maximum height of an upper extremity of said one handle means above the surface when said wheel means are engaged with the surface, the another preselected maximum height being no greater than the first named preselected maximum height.

3. The cleaning device as set forth in claim 1 further comprising a set of releasable means associated with said one handle means for releasable engagement with the other of said handle means of said handle means sets to releasably retain said handle means sets against displacement from the at-rest positions thereof, respectively.

4. The cleaning device as set forth in claim 3 wherein the other of said handle means of said handle means sets include a pair of openings, said releasable means set including a casing, a pair of resiliently urged detent means movable in said casing and received in said openings for effecting the releasable retention of said handle means sets in the at-rest positions thereof, respectively.

5. The cleaning devices as set forth in claim 1 further comprising a set of resiliently urged means contained in part in respective parts of the other of said handle means of said handle means sets and arranged for abutment with respective confronting parts on said one handle means to releasably retain said handle means sets against displacement beyond the extended positions thereof.

6. The cleaning device as set forth in claim 1 further comprising a pair of sets of means associated with said one handle means and arranged for abutment in guiding relation with confronting parts on the other of said handle means of said handle means sets, respectively.

7. The cleaning device as set forth in claim 6 further comprising a pair of sets of adjusting means arranged with said other handle means and at least one of said abutment means of said abutment means sets for adjustably urging said one abutment means into slidable gripping engagement with a confronting one of said confronting parts on said other handle means, respectively.

8. The cleaning device as set forth in claim 1 wherein the other of said handle means of said handle means sets include a pair of sets of articulated means arranged for relative pivotal movement, and one of said articulated means of said articulated means sets extending exteriorly of said one handle means when said handle means sets are in the extended position thereof, respectively.

9. The cleaning device as set forth in claim 8 further comprising a set of means associated with the other of said articulated means of said articulated means sets and operable generally in response to the relative pivotal movement of said one articulated means for interlocking said other articulated means and said one handle means when said handle means sets are in the extended positions thereof, respectively.

10. The cleaning device as set forth in claim 9 wherein said one articulated means includes a set of cam means for conjoint relative pivotal movement with said one articulated means, and said interlocking means including a set of cam follower means engaged in following relation with said cam means for movement between displaced positions and locking positions in interlocking engagement with said one handle means, respectively.

11. The cleaning device as set forth in claim 1 wherein said releasable means includes a pair of pivot pins on said head means, a yoke mounted on the other of said handle means of said handle means sets and including a pair of openings pivotally receiving said pivot pins, respectively, and resilient means for resiliently urging at least one of said pivot pins toward a position on said head means extending through one of said openings in said yoke thereby to releasably retain said yoke against displacement from said pivot pins.

* * * * *